United States Patent [19]

Monfredi

[11] Patent Number: 4,836,413

[45] Date of Patent: Jun. 6, 1989

[54] METHOD AND APPARATUS FOR DISPENSING BOXED GOODS

[75] Inventor: Jim M. Monfredi, 12460 Fern, Chino, Calif. 91710

[73] Assignees: PWS Company; Jim M. Monfedi, both of Monterey Park, Calif.

[21] Appl. No.: 230,730

[22] Filed: Aug. 8, 1988

Related U.S. Application Data

[63] Continuation of Ser. No. 41,982, Apr. 24, 1987, abandoned.

[51] Int. Cl.[4] ..... G07F 11/16

[52] U.S. Cl. ..... 221/270; 221/272

[58] Field of Search ..... 221/254, 268, 270, 224, 221/236, 238, 202, 203, 272

[56] References Cited

U.S. PATENT DOCUMENTS

| | | | |
|---|---|---|---|
| 1,766,297 | 6/1930 | Macke | 221/238 |
| 1,807,404 | 5/1931 | Goss | 221/270 |
| 1,887,197 | 11/1932 | Giles | 221/270 |
| 2,238,725 | 4/1941 | Fry | 221/270 |
| 2,239,196 | 4/1941 | Lupvik | 221/268 |
| 2,913,143 | 11/1959 | Compton | 221/268 |
| 3,119,520 | 1/1964 | Christopher | 221/254 |
| 3,224,643 | 12/1965 | White | 221/238 |

*Primary Examiner*—H. Grant Skaggs

*Attorney, Agent, or Firm*—Gene W. Arant

[57] ABSTRACT

A method for dispensing boxed goods by horizontally ejecting the bottommost box from a vertical stack of boxes. A pusher is engaged with the vertical wall of the bottommost box at about its vertical center and is used to push the bottommost box horizontally outward. When the bottommost box has been pushed part way only, a smooth support is placed behind the pusher and at an elevation below the top of the bottommost box.

When the bottommost box is fully ejected, the support breaks the fall of the next-to-bottom box and supports the entire stack of boxes at an intermediate elevation. Then when the pusher is fully withdrawn, the next-to-bottom box assumes the position formerly occupied by the bottommost box.

In a preferred form, the support means includes a roller attached to the rearward side of the pusher and which rollingly supports the next-to-bottom box as it is being withdrawn.

7 Claims, 4 Drawing Sheets

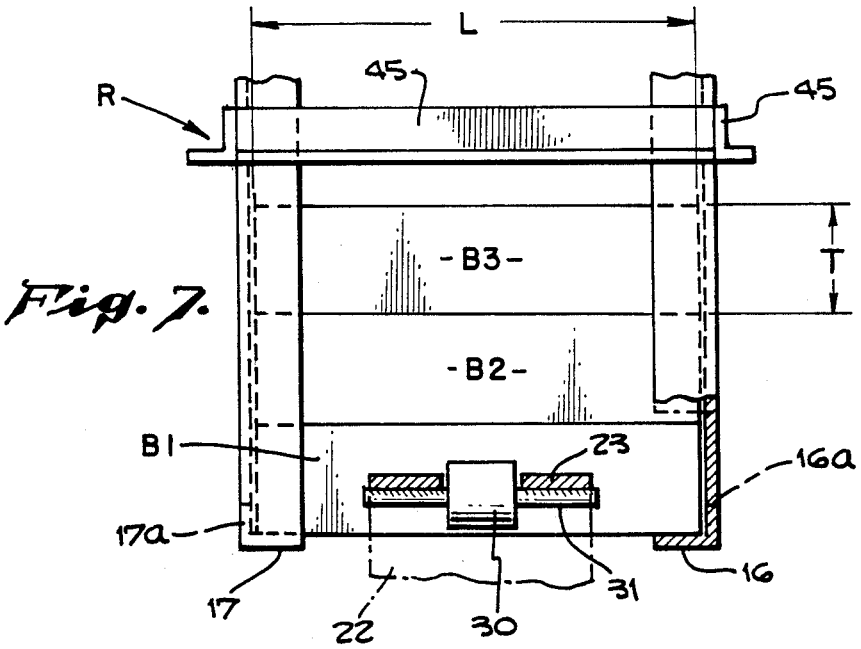
Fig. 7.
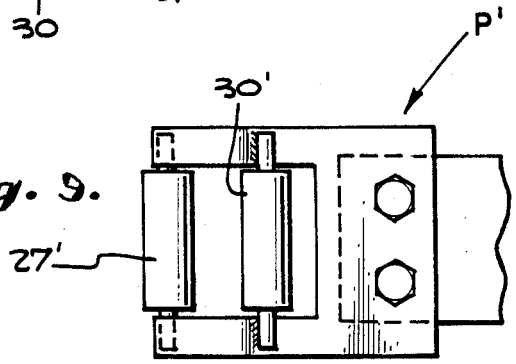
Fig. 9.
Fig. 8.
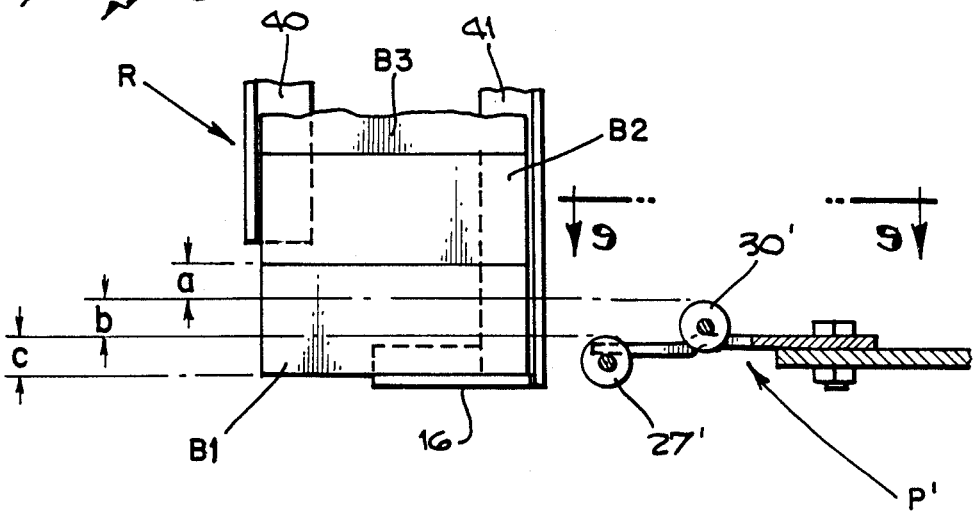

METHOD AND APPARATUS FOR DISPENSING BOXED GOODS

This is a continuation of co-pending application Ser. No. 041,982 filed on Apr. 24, 1987 now abandoned.

BACKGROUND OF THE INVENTION

In the coin vending machine industry it has long been known to place articles to be vended in a vertical stack, and then in response to the customer's insertion of coins into the machine to eject the bottommost article in a horizontal direction from the stack so that it will move through a slide to a location where the customer can reach it.

A need has arisen for a machine that will efficiently dispense cardboard boxes containing, for example, powdered soap. These boxes are of different size and configuration than the items that have hitherto usually been dispensed in coin vending machines.

The present invention relates to a dispensing mechanism for dispensing boxed goods, such as boxes of powdered soap, which is efficient in operation, will not damage the boxes being dispensed, is economical to manufacture, and has a long useful life requiring little or no maintenance.

Thus the object and purpose of the invention is to provide a novel method for dispensing boxed goods which is efficient in operation, and which utilizes an apparatus that is inexpensive to manufacture and reliable and trouble-free.

SUMMARY OF THE INVENTION

According to the novel method of the invention a pusher member is utilized to push the bottommost box of the stack partially out from under the next-to-bottom box, and then a holding means such as a roller is inserted into the space just vacated by the bottommost box, but at an elevation below the upper surface of the bottommost box. Further horizontal movement of the pusher member causes the bottommost box to be completely pushed out from under the stack, at which time the next-to-bottom box drops partially down and is caught by the holding means. The holding means is then withdrawn in a horizontal direction, allowing the next-to-bottom box to drop down further, this time into the position originally occupied by the bottommost box, so that it now itself becomes the bottommost box of the stack. Thus the entire remaining stack of boxes is lowered in two discrete steps when one box (the bottommost one) is dispensed.

According to the presently preferred apparatus of the invention a roller is utilized as the holding means, and the pusher member and the roller are made as parts of a single pusher assembly and are therefore advanced and retracted together. A number of specific features of the mechanism have unobvious but significant advantages.

DRAWING SUMMARY

FIG. 7 is an elevation view, partly in section, taken on Line 7—7 of FIG. 1 or FIG. 3;

FIG. 8 is a side elevation view of a first alternate form of the pusher assembly;

FIG. 9 is a top plan view of the modified pusher assembly taken on Line 9—9 of FIG. 8;

Figure 11:
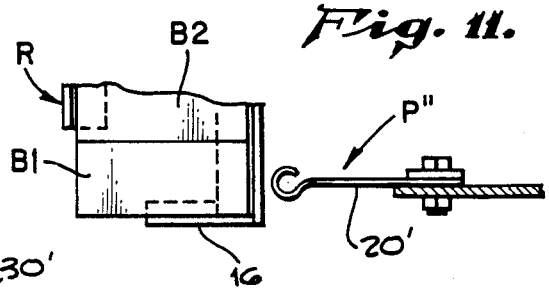
Figure 10B:
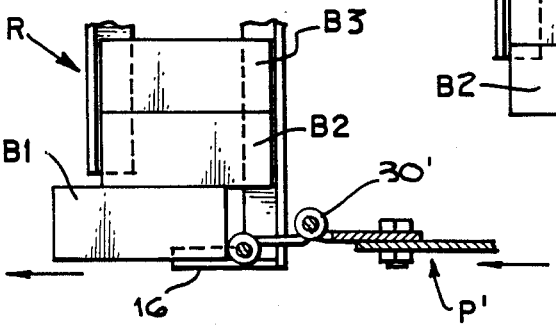
Figure 10D:
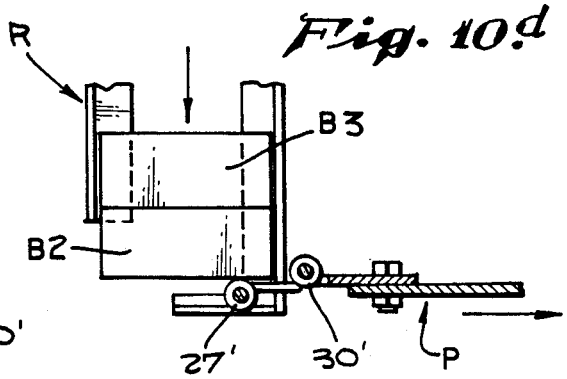
Figure 10C:
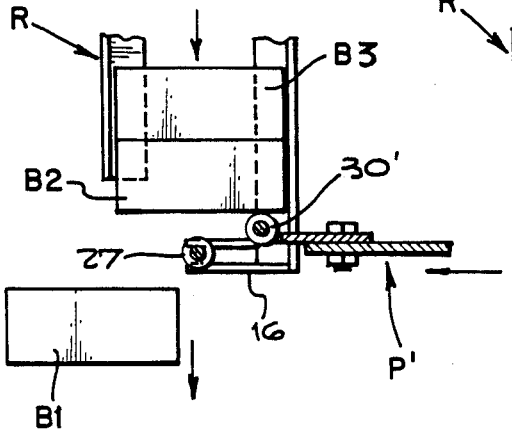
Figure 10E:
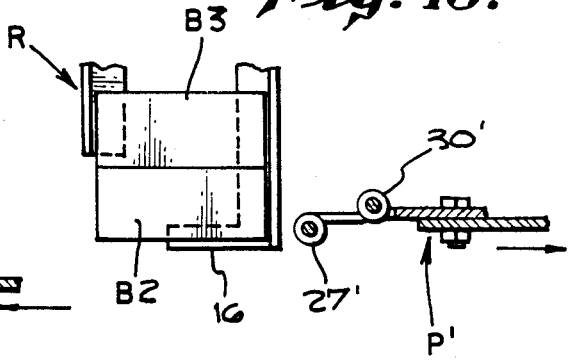

FIGS. 10*a* through 10*e* show successive operating steps of the mechanism of FIG. 8; and FIG. 11 is a side elevation view showing a second alternate form of the pusher assembly.

DETAILED DESCRIPTION

Reference is mow made to the drawings, FIG. 1 through 7, inclusive, illustrating the presently preferred form of my invention.

Figure 1:
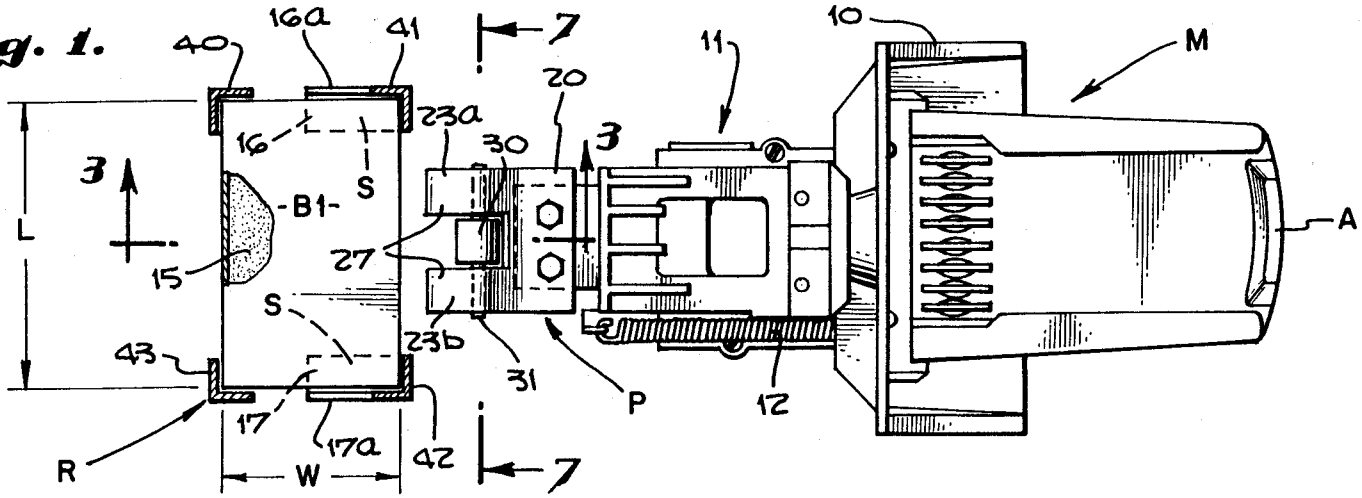
FIG. 1 is a plan view, partly in section, of a machine in accordance with the invention, containing a stack of boxes waiting to be dispensed.
Figure 2:
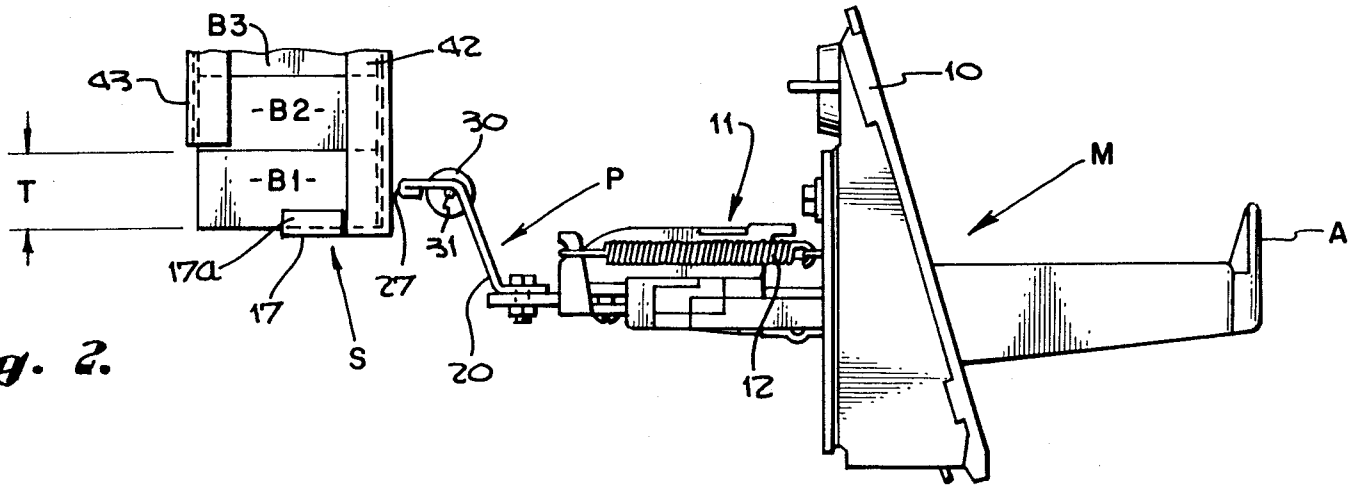
FIG. 2 is a side elevation view of the machine of FIG. 1.
Figure 3:
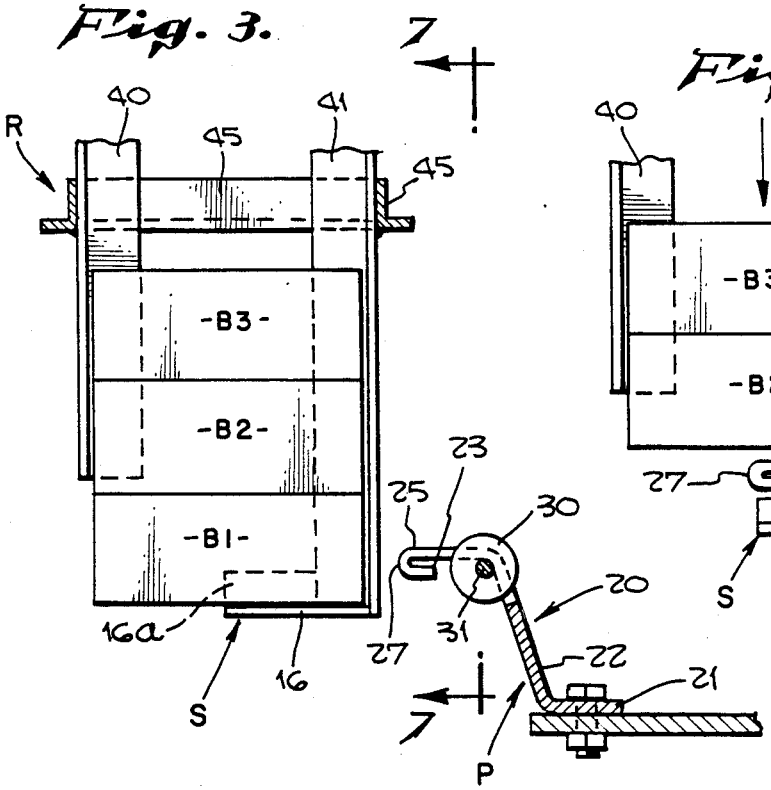
FIG. 3 is an elevation view, partly in cross-section, taken on Line 3—3 of FIG. 1.

As shown in FIGS. 1 and 2, a machine M has a front plate 10 supporting a conventional coin slide 11. Coin slide 11 has a handle A for advancing the coin slide and its related mechanism, and a return spring 12 for returning the coin slide after a box has been dispensed. The coin slide may, for example, be of the type shown in my prior U.S. Pat. No. 4,588,064.

In the interior of the machine a horizontal shelf S supports a vertical stack of boxes B1, B2, B3, etc., where B1 is the bottommost box of the stack. The next-to-bottom box B2 as well as the stack above it are held in their vertically aligned position above the shelf by retaining means R.

A pusher assembly P is attached to the coin slide 11 on the interior of the machine M. The pusher assembly P includes, among its other parts, a pusher member 20 having a pair of pusher faces 27, and a roller 30 supported from pin 31. The function of pusher assembly P, under control of the advancing handle A, is to dispense from the stack the bottommost box, initially B1, and then box B2 and the others in sequence.

The boxes B when stacked in the machine lie on their sides, and not in the upright position in which they would be used for pouring out their powdered soap contents. For convenience in description, with reference to FIGS. 1 and 2, each box has a length L, a width W, and a thickness T. If a box were being used in normal fashion for pouring out its contents its height would be the dimension L, but in the arrangement as stacked inside the machine the vertical height of the box is its thickness dimension T. In FIG. 1 the powdered soap contents of box B1 are indicated by numeral 15.

The dimensions of boxes B may, for example, be such that the thickness T is one inch, the width W is three inches, and the length L is four and one-half inches. The interior dimensions of retaining means R are then selected so as to have a clearance or leeway in both horizontlal directions of about one-eighth inch, so that the vertical movement of the stack will not be impeded when the bottommost box is being dispensed. Alternatively, boxes B may be either larger or smaller, in which event the dimensions of the apparatus will be selected accordingly.

With reference to FIG. 2 it will be seen that shelf S has a horizontal width which is slightly greater than half the width of the box resting upon it, i.e., slightly greater than W/2. While it is possible to make the shelf wider, that would have some disadvantage and no identifiable advantage. It is necessary to have a minimum width greater than W/2 for the situation when the very last box in the stack is being dispensed, and must not be allowed to fall off the shelf prematurely. As shown by dotted lines in FIG. 1 the shelf S has an effective length of about L.

Retainer means R includes a set of four angle irons 40, 41, 42, 43 which are arranged vertically at the four corners of the stack of boxes, so that all the boxes except the bottommost one B1 are restrained from moving out of alignment in any horizontal direction. The bottommost box B1, however, is not confined in all four horizontal directions. The vertical angle irons 41 and 42 extend down all the way to shelf S and are attached to it, thus confining the box B1 in three directions but allowing it to be pushed in a horizontal direction away from the pusher assembly P. Angle irons 40 and 43 terminate a small distance above the bottom of box B2, as best seen in FIG. 2, so as not to present any obstuction to the dispensing movement of the bottommost box.

In theory the bottommost box B1 may simply rest upon shelf S without any horizontal restraints whatever, as it would be sufficiently held in place by frictional contact with the box above it. And in fact the right-hand edge of shelf S as seen in FIG. 1 would not have to be coterminous with the right-hand edge of box B1 but could either extend beyond the edge of the box, or else be set in somewhat from the edge of the box and have an actual width less than W/2. But as a matter of practical convenience it is preferred to restrict the box B1 in three directions by means of the angle irons 41 and 42, as shown; to have the edge of shelf S coterminous with the edge of box B1; and to have the shelf width greater than W/2.

In the illustrated embodiment the shelf S is actually made in two small separate sections 16, 17, attached to angle irons 41, 42, respectively. Shelf section 16 has an upwardly extending side flange **16*a* and section 17 likewise has a vertical flange 17*a*. These flanges guide the horizontal movement of the bottommost box B1** as it is being dispensed.

The angle irons 40–43 are in turn supported by means of an encompassing rail 45 which is located at the elevation of box B4 of the stack. See FIGS. 3, 4 and 7.

Figure 5:
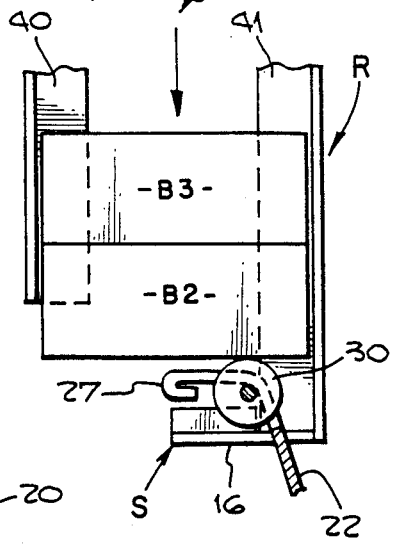
FIG. 5 is a view like FIG. 4 but showing the pusher assembly ready to be retracted after the bottommost box has been dispensed and the next-to-bottom box has dropped partially down.
Figure 4:
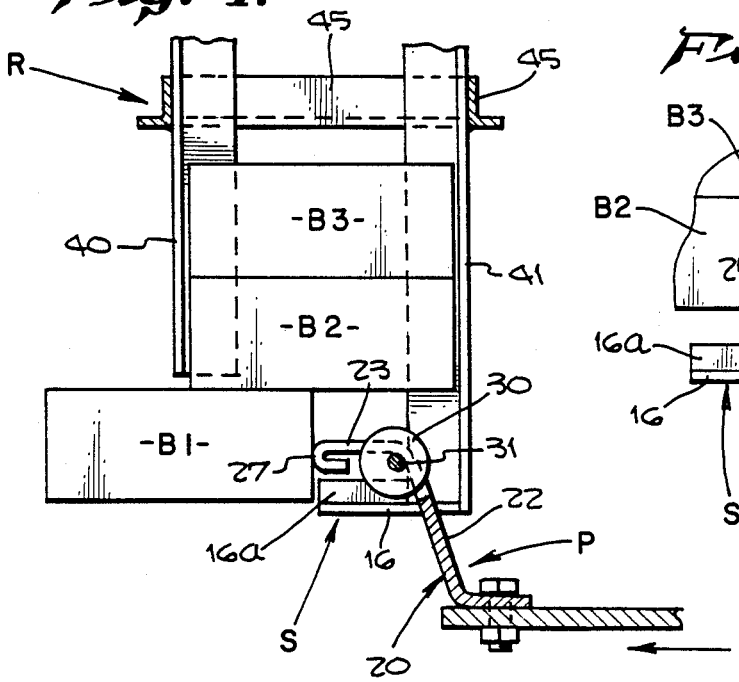
FIG. 4 is a view like FIG. 3 but showing the pusher assembly in the process of dispensing the bottommost box.

As seen in FIGS. 3–6 the pusher assembly P is adapted for a reciprocating horizontal movement above the shelf S. When coins are inserted in machine M and handle A is advanced, pusher means P moves to the left as seen in FIG. 1 or 2. Engagement of pusher faces 27 with the right-hand vertical wall of box B1 first causes the bottommost box B1 to be partially moved from underneath box B2. Then roller 30 on pusher assembly P moves into the space just vacated by box B1, but with the upper surface of the roller at a lower level than the upper surface of box B1. See FIG. 4. As box B1 is pushed further and drops off the left side of shelf S, box B2 drops down a distance of about T/3 and rests upon the roller 30, as shown in FIG. 5.

Figure 6:
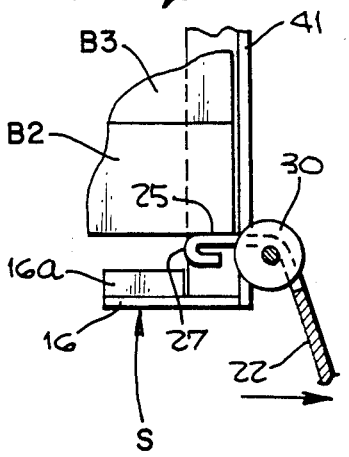
FIG. 6 is a view like FIG. 5 but showing the pusher assembly partly retracted and the next-to-bottom box having dropped still further.
Figure 10A:
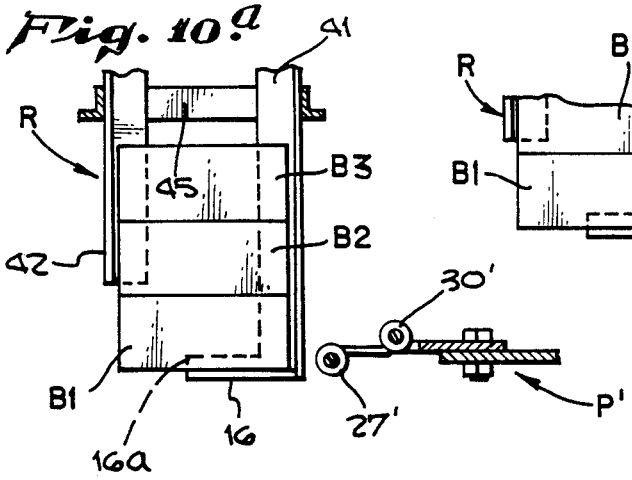

The pusher assembly is automatically retracted by action of the coin slide return spring 12. Retraction of the pusher assembly then causes roller 30 to be horizontally withdrawn in a direction opposite to that in which box B1 was moved. When the roller passes out from underneath box B2, box B2 drops down a small additional distance and rests upon the upper surfaces 25 of the pusher member 20, as shown in FIG. 6. Upon further retraction of the pusher means P the box B2 drops down a further distance of the order of T/2, not specifically shown in the drawings, so that it then occupies the position originally occupied by box B1. During that last downward movement of box B2 its lower right hand corner rides on the smoothly rounded surfaces between horizontal upwardly facing surfaces 25 and vertical pusher faces 27 of the pusher member 20.

In the particular machine as illustrated, the inner portion of the coin slide is at a lower elevation than the shelf S. This is a matter of the dimensional parameters of the particular machine. In general, the shelf S may be either at the same elevation as the coin slide, or below the elevation of the coin slide, or above the elevation of the coin slide as presently shown.

In this presently preferred embodiment of my invention the shelf S supports box B1 at both its ends, but the shelf does not have a continuous length throughout the length L of the box. Specifically, shelf S is made with two separate end pieces 16, 17 having a considerable space between them. See FIGS. 1 and 7. It will be seen that the space between end pieces 16 and 17 accommodates the movements of pusher member 20.

The structure of pusher assembly P will now be described more specifically. Pusher member 20 is made from a single iron bar having a lower end 21 which is fixedly attached to the extremity of the coin slide; an angled portion 22 which rises to an elevation somewhat above that of shelf S; and a horizontally bifurcated top plate portion 23. The top plate 23 is generally flat with a central cut-out region forming a pair of spaced arms **23*a*, 23*b* (FIG. 1). Each arm of the top plate 23 has a horizontal upwardly facing surface 25 and is bent over in a smooth curve through an angle of more than 90 degrees so as to provide a vertical pusher face 27 as well as a curved surface above that face and a curved surface below it. Roller 30 is disposed within the cut-out region between arms 23*a*, 23*b*. The pin 31 is parallel to both pusher faces 27 and has its ends secured as by welding to the respective arms 23*a*, 23*b*. The distance between the axis of pin 31 and the pusher faces 27** is somewhat less than W/2.

During reciprocating movements of the coin slide angled portion 22 of the pusher member 20 passes through the space between the separate portions 16, 17 and shelf S. It will be understood that this feature of the arrangement is provided in order to accommodate the fact that coin slide 11 is at a lower elevation than shelf S, in the particulaar machine.

It is significant that in the operation of the dispensing apparatus each box is handled in such a way as to avoid damage to it or its contents; yet there is a steady step-by-step action advancing each box in the direction it must move. Thus the box B2 is lowered not in a single step, but in a succession of three steps, as it takes the place formerly occupied by box B1. And the pusher faces 27 are rounded in the vertical direction so as to temporarily make a necessary small indentation in the vertical wall surface of the box B1 but without any permanent damage whatsoever to the box. Also, the pusher faces engage box B1 at approximately the vertical center of its side wall. And they are positioned at about the one-third points of its lengdth so that they are effective at the horizontal center of the box and the most effective mechanical action is achieved in pushing box B1 from underneath the stack.

At the same time it will be noted that the construction of the pusher assembly P is very simple, since the pin 31 which supports roller 30 from the two arms of the pusher member 20 upper end 23 is simply welded to those two arms. Further, the operation of the roller 30 produces minimum friction against the under surface of box B2, as the pusher is being retracted. Thus, return spring 12 does not need to be made of extra strength, and is therefore not difficult for the customer to overcome when he or she has inserted coins in the machine and then moves the advancing handle A forward. In other words, the operation of the roller in reducing friction during the retracting movement of the pusher assembly reduces the work the customer must do in advancing the coin slide.

Reference is now made to FIGS. 8–10 illustrating a modified form of the invention. The modified pusher assembly P′ includes 27′ and 30′. In the operation of this device the stack of boxes is lowered in three equal steps identified in FIG. 8 by letters a, b, and c. FIG. 10 illustrates the sequence of operating steps.

Reference is now made to FIG. 11 illustrating a second alternative form of pusher assembly P″. Pusher member 20′ is somewhat resilient rather than being entirely ridgid as in the earlier embodiments. Therefore, as the pusher member is withdrawn, the partial dropping of the next-to-bottom box B2 will cause it (and the stack above it) to be resiliently supported until the pusher member has been completely withdrawn.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What I claim is:

1. In a vending machine of the type which includes a vertical stack of boxed goods, a horizontal shelf for supporting the stack, means for restraining all but the lowermost box within the stack against horizontal movement, a horizontally movable coin slide having a return spring, and an ejector mechanism associated with the slide for ejecting the lowermost box from the stack by moving it horizontally through a predetermined distance relative to the shelf until it falls off the shelf and allows the remaining stack to drop down onto the shelf, the improvement comprising:

the ejector mechanism consisting of a rigid, elongated, one-piece pushing member having a first end rigidly fixed to an end of the coin slide for coextensive horizontal reciprocal movements therewith through protractive and retractive strokes, each stroke having a length at least equal to the predetermined distance, and a second end disposed, in a fully-retracted position of the pushing member, adjacent to the center of a sidewall of the lowermost box, for moving the lowermost box horizontally relative to the stack during a protractive stroke of the member;

means associated with the ejector mechanism for lowering the remaining stack onto the shelf in at least two sequential drops, including an upwardly-directed follower positioned on the pushing member adjacent and slightly above the second end for sequentially following the second end below the remaining stack during the protractive stroke of the member, catching the remaining stack at a position above the shelf at about the end of the protractive stroke, holding the remaining stack in that position above the shelf during the retractive movement of the member, and lowering the remaining stack onto the shelf at about the end of the retractive stroke;

the follower comprising a roller rotatably mounted on the pushing member, the roller having a horizontal axis of rotation perpendicular to the stroke movement of the pushing member and a rolling surface positioned to extend slightly above the second end of the member and to follow it during protractive movement of the member; and the pusher member further comprising a flat portion inclusive of the second end having a central notch therein forming a pair of spaced arms, the ends of each arm being bent over in a curved configuration through an angle greater than a right angle to form a pair of aligned, rounded pusher faces, and a pin extending across the notch parallel to the pusher faces, the pin having opposite ends secured to respective ones of the arms and the roller being journalled thereon between the arms.

2. A coin vending machine for vending boxed goods by removing the lowermost box from a stack of boxes in response to the insertion of coins, characterized by concurrently lowering the stack of boxes in three separate and successive steps, said machine comprising:

a horizontal shelf for supporting the stack of boxes;

means for restraining all but the lowermost box in the stack against horizontal movement;

a horizontally movable coin slide having a return spring;

an elongated rigid pushing member having one end thereof rigidly affixed to said coin slide for coextensive horizontal reciprocal movement therewith, said pushing member at its other end being smoothly curved in the vertical plane so as to provide a vertical pusher face as well as a curved surface above that face and a curved surface below it;

said shelf and said pushing member being so positioned relative to each other that said pusher face normally engages a vertical wall of the bottommost box of the stack at about its vertical and horizontal centers;

a roller supported upon said pushing member for rotation about an axis which is parallel to said pusher face, said roller being set back somewhat from said pusher face so as to provide an upwardly facing horizontal support surface between said pusher face and said roller, and the upper surface of said roller being above said horizontal support surface;

so that when coins are inserted into said coin slide and said coin slide is advanced (a) said pusher face engages the bottommost box at about its vertical and horizontal centers, (b) the bottommost box falls off the shelf, thereby allowing the remaining stack of boxes to drop down until the next-to-bottom box becomes supported by said roller, (c) said coin slide and pushing member are retracted by said return spring and the remaining stack of boxes are supported by the rolling engagement of said roller with the under side of what was previously the next-to-bottom box, (d) said previously next-to-bottom box then falls from said roller onto said horizontal support surface and therefore allows the remaining stack of boxes to be lowered accordingly, and (e) finally a corner of the previously next-to-bottom box slides along the vertically rounded surface of the pusher face until that box comes to rest upon said shelf and thereby itself becomes the bottommost box of the stack.

3. A machine as in claim 2 wherein said shelf is bifurcated in a direction perpendicular to the movement of said pusher member, having two separate sections with a space therebetween, and said pushing member reciprocates within said space.

4. A machine as in claim 2 wherein said smoothly curved end of said pushing member is curved through an angle of more than 90 degrees.

5. A machine for dispensing powdered soap or the like contained in cardboard boxes, comprising:

a shelf for supporting the bottommost box of a vertical stack of boxes, said shelf having an effective horizontal width which is at least half the horizontal width of a box;

means for restraining all of the boxes except the bottommost one against horizontal movement;

a horizontally movable coin slide having a return spring;

a pusher assembly rigidly attached to said coin slide to be coextensively advanced and retracted therewith with no relative movement therebetween, said pusher assembly including (a) a rigid pusher member disposed to move only horizontally with said slide and having an end face adapted to pushingly engage a vertical wall of the bottommost box at about its vertical center, (b) a roller mounted on said pusher member rearwardly of said end face, the upper surface of said roller extending at least slightly above said pusher member end face, (c) an upwardly facing supprt surface extending horizontally between said end face and said roller; and the horizontal separation between said end face and the top of said roller being less than the effective width of said shelf;

so that after ejection of the bottommost box from said shelf, the next-to-bottom box drops onto said roller and is rollingly supported thereon in an intermediate position above said shelf while said pusher assembly is retracted under control of said return spring, is then allowed to drop onto said upwardly facing horizontal support surface, and then when said pusher assembly becomes about fully retracted is allowed to drop onto said shelf.

6. A machine as in claim 5, wherein said pusher assembly comprises:

a metal pusher plate having a generally flat end portion with a central cut-out region forming a pair of spaced arms, the end of each arm being bent over in a curved configuration through an angle of more than 90 degrees to form a pusher face;

a roller disposed within the cut-out region between said arms;

a pin extending across the cut-out region and rotatably supporting said roller, the ends of said pin being secured to respective ones of said arms;

said pin being parallel to both of said pusher faces; and each of said arms having an upwardly facing horizontal support surface between its respective pusher face and said roller.

7. A pusher assembly as in claim 6 wherein the horizontal distance between said pusher faces and said pin is less than half the horizontal width of the box that is to be ejected.

* * * * *